US009562676B2

(12) United States Patent
Holt

(10) Patent No.: US 9,562,676 B2
(45) Date of Patent: Feb. 7, 2017

(54) CONTROL TECHNIQUES FOR LIGHTING FIXTURES HAVING SPATIAL DISTRIBUTION CONTROL CAPABILITIES

(71) Applicant: Jeffrey W. Holt, Concord, NH (US)

(72) Inventor: Jeffrey W. Holt, Concord, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 264 days.

(21) Appl. No.: 14/038,985

(22) Filed: Sep. 27, 2013

(65) Prior Publication Data

US 2015/0092428 A1 Apr. 2, 2015

(51) Int. Cl.
*F21V 21/14* (2006.01)
*F21V 21/15* (2006.01)
(Continued)

(52) U.S. Cl.
CPC ..... *F21V 21/14* (2013.01); *F21V 21/15* (2013.01); *H05B 33/0842* (2013.01); *F21W 2131/406* (2013.01)

(58) Field of Classification Search
CPC ..... A43B 3/001; F21V 21/14; F21V 21/15; F21W 2131/406; F21S 8/04; F21S 8/046; F21S 8/06; F21S 8/061; F21S 8/063; F21S 8/065; F21S 8/066; H05B 37/0245; H05B 37/0254; H05B 37/0263; H05B 37/0272; H05B 37/029; G02B 26/08
(Continued)

(56) References Cited

U.S. PATENT DOCUMENTS 5,012,398 A 4/1991 Jones et al.
5,068,767 A * 11/1991 Koyama ..... F21S 2/00 315/152
(Continued)

FOREIGN PATENT DOCUMENTS

DE 10045028 A1 4/2002
EP 2428720 A2 3/2012
(Continued)

OTHER PUBLICATIONS

Patent Abstract of German Publication No. DE10045028, Publication Date: Apr. 4, 2002, downloaded from Espacenet (1 page).
(Continued)

*Primary Examiner* — Anh Mai
*Assistant Examiner* — Steven Horikoshi
(74) *Attorney, Agent, or Firm* — Yutian Ling

(57) ABSTRACT

Techniques and user interfaces are disclosed for controlling lighting fixtures having spatial distribution control capabilities. In some cases, the control techniques may use a high-level controller to define target and spread inputs for a desired illumination pattern provided by a lighting fixture in a given area to be lit. In such cases, the target and spread inputs may be transmitted, or otherwise provided, to a control module, which may be included in the lighting fixture. The control module may be configured to translate the inputs into the appropriate movements and/or light source adjustments based on the specific lighting fixture being used to achieve the desired illumination pattern. In some cases, multiple lighting fixtures may be controlled by one or more control modules. In such cases, the high-level controller may be configured to provide inputs to the control module(s) to cause one or more illumination patterns using the lighting fixtures.

19 Claims, 11 Drawing Sheets

(51) Int. Cl.
*H05B 33/08* (2006.01)
*F21W 131/406* (2006.01)

(58) Field of Classification Search
USPC ..... 362/85
See application file for complete search history.

(56) References Cited

U.S. PATENT DOCUMENTS

| | | | | |
|---|---|---|---|---|
| 7,857,492 | B2 * | 12/2010 | Dixon | F21S 8/00 362/287 |
| 2014/0343699 | A1 * | 11/2014 | Engelen | G06T 15/506 700/90 |

FOREIGN PATENT DOCUMENTS

| | | | |
|---|---|---|---|
| WO | 0216824 | A1 | 2/2002 |
| WO | 2007036581 | A1 | 4/2007 |
| WO | 2009130644 | A1 | 10/2009 |
| WO | 2010010490 | A1 | 1/2010 |

OTHER PUBLICATIONS

Prouteau, Evelyne, International Search Report and Written Opinion of the International Searching Authority for PCT/US2014/057303 filed on Sep. 24, 2014, dated May 18, 2015, European Patent Office, Rijswijk, The Netherlands (16 pages).

* cited by examiner

XY Plate - Linear Corrections

```
// Constants derived from physical make up and calibration
Zero_Offset          //Shift "zero" from fixture reference to actuator reference
Pin_Offset           //Offset to account for non-parallel actuator (where actuator movement is not
coincident with plate movement)
Setting_Scale        //Scale for actuator setting per linear distance (actuator pin)
Actuator_Offset      //Offset for setting representing actuator "zero" in actuator reference
Plate_Offset         //Distance the plate is offset from module ball joint

// Inputs
Target_Vector        //Target in fixture reference XYZ

// Calculations
Unit_Vector = Target_Vector / (|Target_Vector|)                    //Create a Unit Vector
Desired_Plate_Position = Unit_Vector * (Target_Vector(Z) / Plate_Offset)    //Translate to plate movement
Actuator_Target = sqrt( (Desired_Plate_Position - Zero_Offset)^2 + (Pin_Offset)^2)    //Correct for
triangular structure
Actuator_Setting = (Actuator_Target - Actuator_Offset) * Setting_Scale    //Correct for actuator setting
```

Focus Plate - Rotational Corrections

```
// Constants derived from physical make up and calibration
Lens_Angle           //FWHM of individual optics
Setting_Scale        //Scale for actuator setting per distance move toward center of plate
Setting_Neutral      //Setting for actuator at neutral
RPlate_Neutral       //Radius of the outermost ring of the "rotation" plate where modules are in neutral
RPlate_Offset        //Distance the focus plate is offset from module ball joint

// Inputs
Focus                //Desired radius of FWHM on surface, in fixture units
Distance             //Distance from fixture to the point on surface (center of desired area), in fixture units

// Output
R_Setting            //Setting in actuator set point units to achieve desired "focus" at target location

// Calculations
Fully_Focused = Distance * TAN(0.5 * FWHM)    //Calculate what would be tightest "focus" possible
TAN = (Focus - Fully_Focused - RPlate_Neutral) / Distance    //Find the tangent of the angle outer
modules should point, constrain
Delta_R =  TAN * RPlate_Offest    //Distance to move from neutral (to or from center, at rotation plate)
R_Setting = Delta_R * Setting_Scale    //Scale and done
```

Fig. 11

CONTROL TECHNIQUES FOR LIGHTING FIXTURES HAVING SPATIAL DISTRIBUTION CONTROL CAPABILITIES

RELATED APPLICATIONS

This Application is related to U.S. application Ser. No. 14/039,054, filed on Sep. 27, 2013, and titled "Lighting Fixture Having Spatial Distribution Control Capabilities" which is herein incorporated by reference in its entirety.

FIELD OF THE DISCLOSURE

This disclosure relates to lighting fixtures, and more particularly to lighting fixtures having spatial distribution control capabilities and techniques for controlling such fixtures.

BACKGROUND

Lighting and lighting fixtures are becoming more dynamic, including the ability to control various aspects of the lighting, such as brightness/dimming, color, and spatial distribution. Spatial distribution of lighting may include the aim (target) and/or focus (spread) of the light provided by a fixture or system. One example of a lighting fixture that allows for spatial distribution control is a moving head lighting fixture, which is typically used in theater and stage lighting. In these fixtures, a lighting head unit is mounted on a motorized setup (e.g., double gantry or gimbal setup) that allows for directional aiming of a high intensity point light source. In addition, the moving head light may use optics for focusing/spot size adjustment. Moving head lighting fixtures, as well as other lighting fixtures that allow control of lighting spatial distribution, are controlled in many ways. Typically the fixtures are connected to a lighting control console, which sends signals to the motors or actuators of the fixture.

BRIEF DESCRIPTION OF THE DRAWINGS

FIG. 11 illustrates an example control module pseudo code for corrections and calculations of a lighting fixture having spatial distribution control capabilities, in accordance with an embodiment of the present invention.

Figure 1:
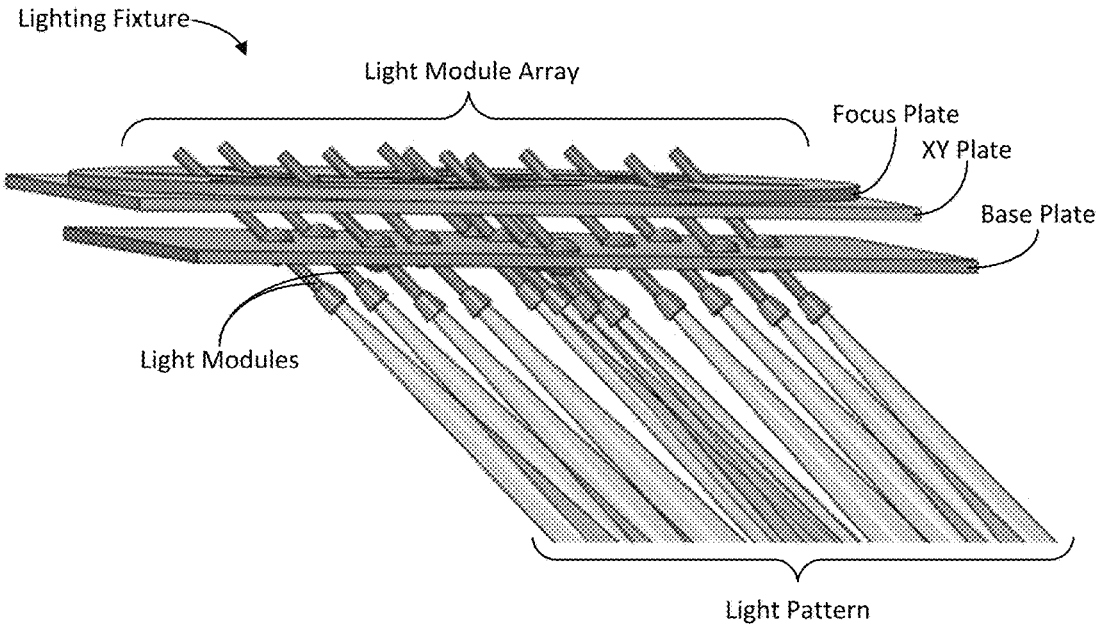
FIG. 1 illustrates a lighting fixture assembly having spatial distribution control capabilities, configured in accordance with an embodiment of the present invention.

These and other features of the present embodiments will be understood better by reading the following detailed description, taken together with the figures herein described. The accompanying drawings are not intended to be drawn to scale.

DETAILED DESCRIPTION

Techniques and user interfaces are disclosed for controlling lighting fixtures having spatial distribution control capabilities. In some cases, the control techniques may use a high-level controller to define target and spread inputs for a desired illumination pattern provided by a lighting fixture in a given area to be lit. In such cases, the target and spread inputs may be transmitted, or otherwise provided, to a control module, which may be included in the lighting fixture. The control module may be configured to translate the inputs into the appropriate movements and/or light source adjustments based on the specific lighting fixture being used to achieve the desired illumination pattern. In some cases, multiple lighting fixtures may be controlled by one or more control modules. In such cases, the high-level controller may be configured to provide inputs to the control module(s) to cause one or more illumination patterns using the lighting fixtures. Numerous variations and configurations will be apparent in light of this disclosure.

General Overview

As previously explained, currently available lighting fixtures that allow for dynamic light aiming and/or focusing typically have a single head that can be moved around for aiming purposes. However, such moving head lighting fixtures are relatively expensive and complicated to use. In addition, moving head fixtures have a form factor that is not well suited to applications outside of theater and stage lighting.

Thus and in accordance with one or more embodiments of the present invention, lighting fixtures having spatial distribution control capabilities and intuitive techniques for controlling such lighting fixtures are provided. As will be apparent in light of this disclosure, spatial distribution in the context of a lighting fixture or its light modules/sources, as well as the illumination pattern provided therefrom, may include target (aim) and/or focus (spread). In some embodiments, the lighting fixture may include an array of light modules, each containing one or more light sources, with the fixture further including multiple plates that can be used to control the spatial distribution of the light modules. For example, the multi-plate lighting fixture may include a base plate that is fixed or stationary and includes multiple sockets, an XY plate that is movably coupled to the base plate and includes multiple slots, and a focus plate that is rotationally coupled to the XY plate and includes multiple slots. Each light module may include a ball portion that is pivotally retained by a base plate socket. In addition, each light module may include a control arm that is disposed or located within at least one slot in each of the XY plate and the focus plate. Thus, the control arms may be constrained by (or disposed within) the XY and focus plates to allow movement of the XY plate to mechanically aim the light modules and rotation of the focus plate to mechanically focus the light modules, as will be discussed in detail below.

As previously described, the multi-plate lighting may include multiple light sources, which can include one or more LEDs, laser diodes, high intensity discharge (HID) bulbs, incandescent bulbs, and/or fluorescent bulbs, for example. In some cases, the multi-plate lighting fixtures may include dimming or color-changing control capabilities, or control over other aspects of the light provided, as will be apparent in light of this disclosure. In some cases, the multi-plate lighting fixture may come fully assembled, such that a user can readily install the assembly in the desired room or area of use, for example. In other cases, the lighting fixture may come as a kit, where the individual components (e.g., the plates and light modules) come unassembled and the user has to assemble the lighting fixture before installation. In such cases, the kit may include instructions for assembly. In yet other cases, a user may be able to purchase the individual components of the assembly to create a fully assembled lighting fixture having multiple plates and light modules as variously described herein. In such cases, the user may be able to select variations for the plates and/or lighting modules, such as the number of lighting modules, array pattern, colors, materials, light sources, sizes, weights, etc.

The multi-plate lighting fixture may provide one or more advantages/benefits over currently available lighting fixtures having spatial distribution control capabilities. For example, the multi-plate fixture employs a mechanical scheme to aim and/or focus all of its light modules simultaneously through the movement of one plate (e.g., XY or focus plate). Further, the fixture may be manually operated or automated, depending upon the particular configuration. Also, the fixture can use inexpensive light sources, such as LEDs combined with simple fixed optics that are widely available (e.g., total internal reflection lenses). In addition, the entire fixture can be constructed to be relatively thin (e.g., having a short maximum overall height), which may be beneficial for fitting commonly used form factors in both general and specialty lighting (e.g., a troffer-type fixture or medical boom fixture). Other advantages/benefits associated with one or more embodiments of the present invention will be apparent in light of this disclosure.

The control techniques described herein may be used to provide a more intuitive user experience for controlling lighting fixtures having automated spatial distribution control capabilities. As will be apparent in light of this disclosure, the control techniques can be used for any type of lighting fixture, such as a multi-plate lighting fixture as variously described herein, a moving head lighting fixture, or a stationary fixture having multiple light sources (e.g., where spatial distribution is controlled by turning the light sources one or off). In general, the control techniques as variously described herein allow a user to define spatial distribution of one or more lighting fixtures in real-world or global units to achieve a desired illumination pattern. In other words, the control techniques allow a user to set a desired target and spread in an area, based on the area itself. For example, in some embodiments, the control techniques include defining a target input (e.g., using X, Y, and/or Z coordinates) and a spread input (e.g., using a focus radius) for a given area using a high-level controller. In such an example, the area may be a kitchen in a house or an operating room in a hospital, where the user can select the target and spread of one or more illumination patterns in the room provided by one or more lighting fixtures, for instance.

The target and spread inputs may be determined by mapping a room or area, setting the center or corner of the room as the origin, and using the dimensions of the room (e.g., in feet or meters) to set the coordinates, or by some other suitable technique as will be apparent in light of this disclosure. The high level controller may be a dedicated remote, or an application on a computer, smart phone, or tablet, for example. The target input and spread input can then be transmitted or sent to a control module to determine the appropriate movements and/or light source adjustments used to achieve the desired illumination pattern. In some instances, the control module may correct for the geometry of the fixtures it controls and/or the calibration of the actuators used in any of the fixtures it controls. In addition, in some instances, the control techniques may include a calibration process to set the shape and/or size of the area being used and the relative position of the lighting fixture(s) in the area, as will be discussed herein. Note that use of the term high-level controller may include any combination of software, hardware, or firmware configured to allow a user to provide inputs (e.g., target and spread inputs) which may be used to control one or more lighting fixtures as described herein and that use of the high-level controller terminology is not intended to limit the present disclosure.

In some embodiments, the high-level controller user interface (UI) may include a virtual map of desired light distribution in a room, space, or area of use, as will be apparent in light of this disclosure. In some cases, the high-level controller may be configured to control multiple lighting fixtures. In such cases, the lighting fixtures may be controlled individually (e.g., where each fixture has its own illumination pattern) or together (e.g., where two or more lighting fixtures are used to provide a single illumination pattern). Further, in such cases, the UI may include options to group/ungroup fixtures as desired. In addition, in some cases, the high-level controller may be able to break down the virtual map in sections to be assigned to individual fixtures or groups of fixtures in a space (note that the sections may overlap). As will be apparent in light of this disclosure, the control modules disclosed herein may be located in individual fixtures or in another suitable location (e.g., in a central controller), and may be configured to control one or multiple lighting fixtures. Numerous variations and configurations will also be apparent in light of this disclosure.

Multi-Plate Lighting Fixture Assembly

Figure 2:
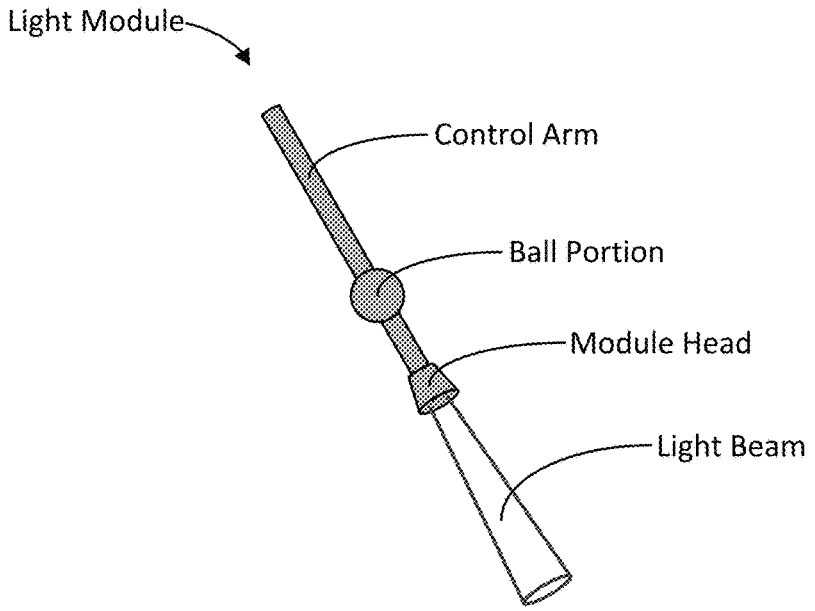
FIG. 2 illustrates an example light module for use in the lighting fixture assembly of FIG. 1.
Figure 3:
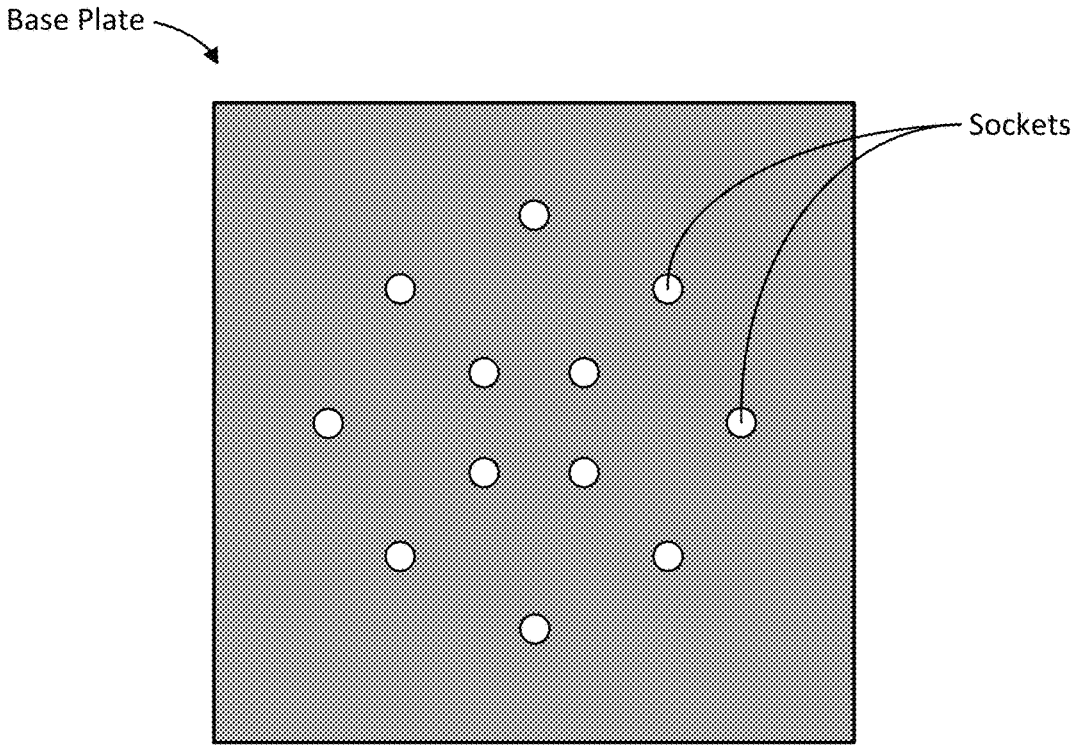
FIG. 3 illustrates a top view of an example base plate for use in the lighting fixture assembly of FIG. 1.
Figure 4A:
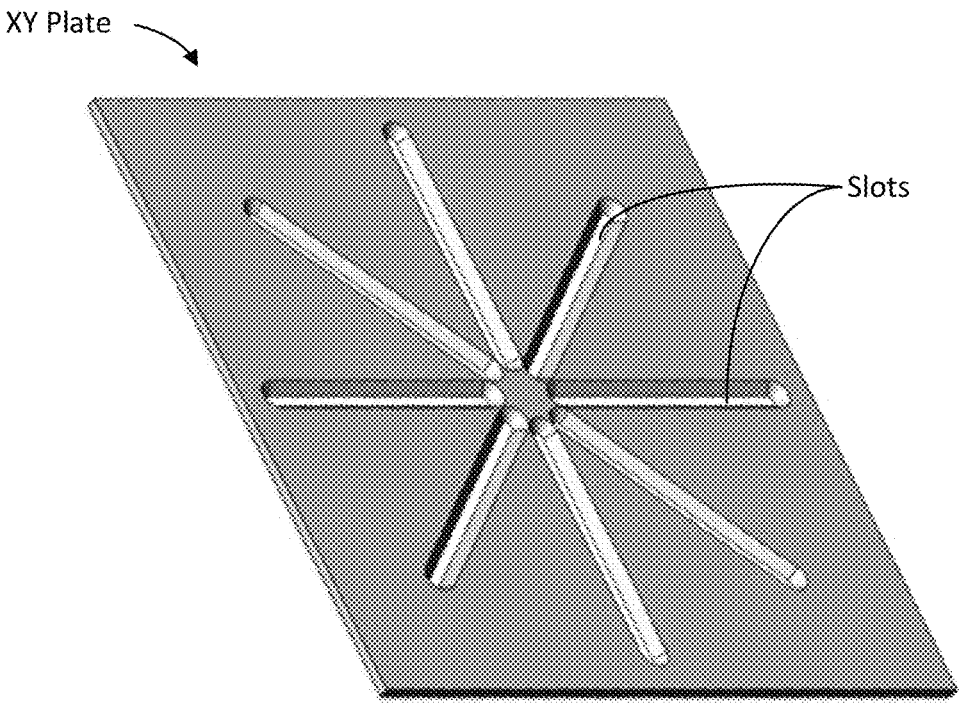
FIGS. 4*a-b* illustrate a perspective and top view, respectively, of an example XY plate for use in the lighting fixture assembly of FIG. 1.
Figure 4B:
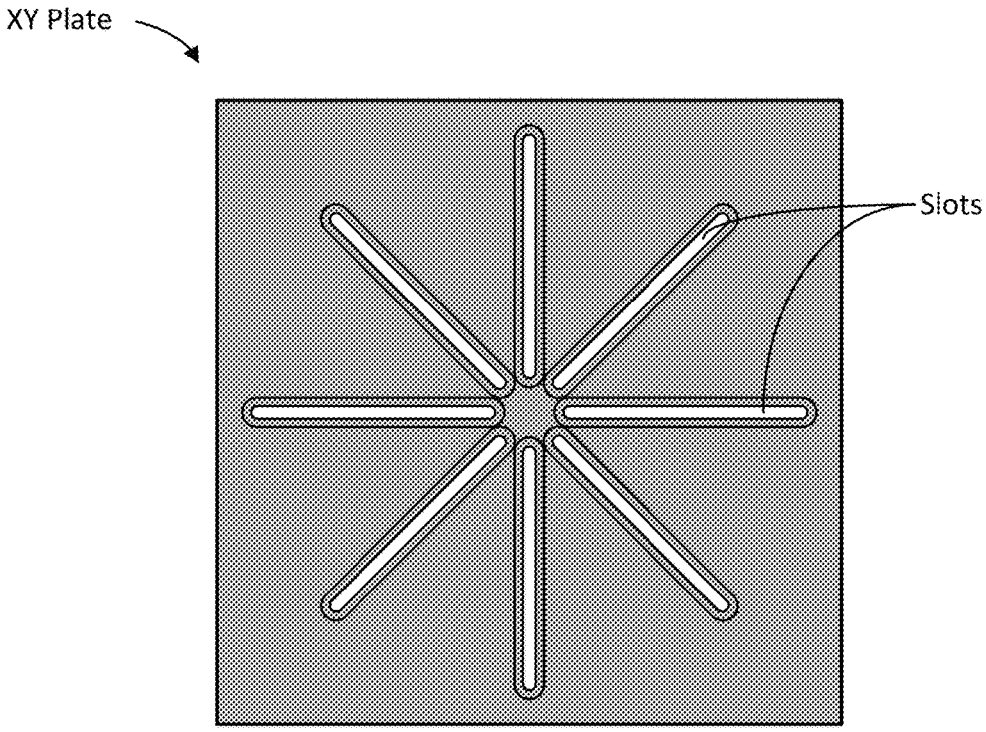
Figure 5A:
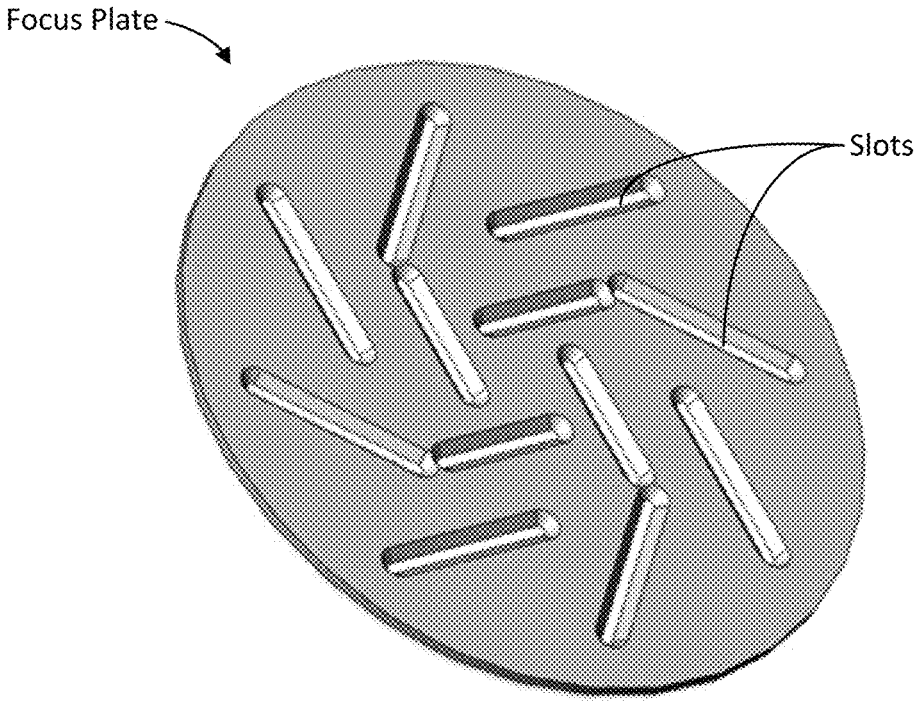
FIGS. 5*a-b* illustrate a perspective and top view, respectively, of an example focus plate for use in the lighting fixture assembly of FIG. 1.
Figure 5B:
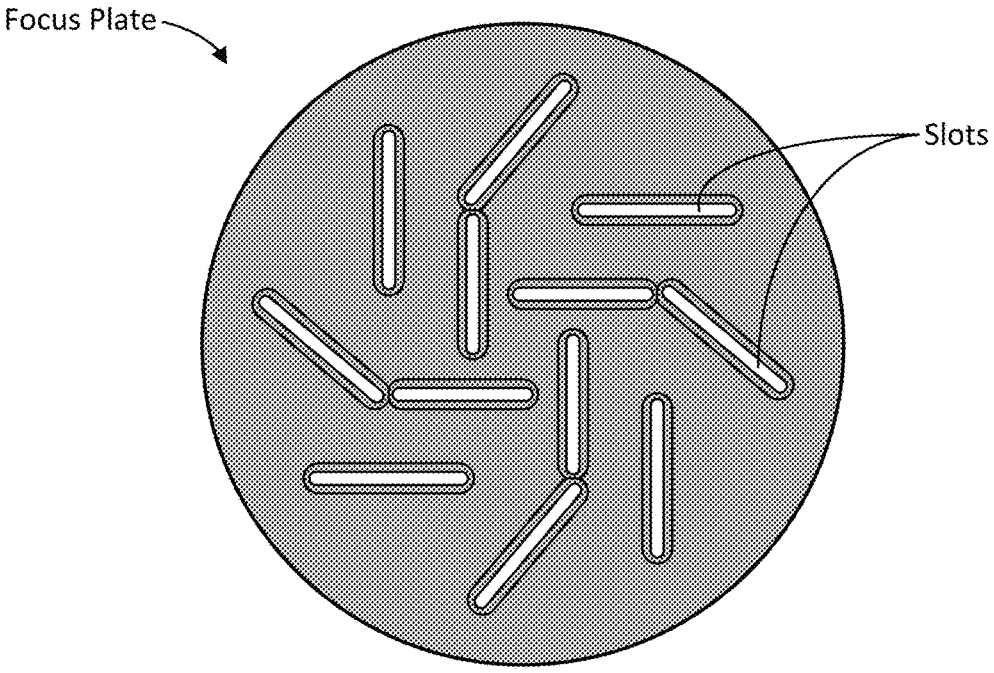

FIG. 1 illustrates a lighting fixture assembly having spatial distribution control capabilities, configured in accordance with an embodiment of the present invention. In this embodiment, the lighting fixture is an assembly that includes multiple light modules (one of which is shown in FIG. 2), which comprise an array and form a particular light pattern depending upon the specific configuration of the lighting fixture. The lighting fixture assembly in this example embodiment also includes multiple plates, and more specifically, a base plate (as shown in FIG. 3), an XY plate (as shown in FIGS. 4*a-b*) capable of aiming the light modules, and a focus plate (as shown in FIGS. 5*a-b*) capable of focusing the light modules, each of which will be discussed in more detail below. As will be appreciated in light of this disclosure, the lighting fixture assembly may include additional, fewer, and/or different elements or components from those here described (e.g., fewer, additional, or different light modules).

The plates in FIG. 1 are shown disconnected; however, they may be connected to each other or other structures in any suitable manner to facilitate control of the spatial distribution of the light module array as variously described herein. For example, the plates may be connected using one or more arms (e.g., spring-balanced, hydraulic, pneumatic, etc.), wires, connecting plates or planks, counterweights, and/or other suitable components as will be apparent in light of this disclosure. In some cases, one or more of the plates may be connected to another structure, such as a ceiling or wall (not shown) to facilitate movement of the plates as described herein. For example, in some embodiments, the base plate may be connected to the ceiling to provide a stationary base or the base plate may be connected to another fixture, such as a troffer, that contains or encompasses the lighting fixture. In such embodiments, the XY plate may be moved relative to the base plate to aim (target) the light module array as desired. In other embodiments, the XY plate or focus plate may be secured (e.g., to a ceiling) to allow for the other plates to move relative to the secured plate. In other words, any of the three plates shown in FIG. 1 may be fixed to facilitate movement of one or both of the other two plates.

FIG. 2 illustrates an example light module for use in the lighting fixture assembly of FIG. 1. As shown, the body of the example light module in this embodiment includes a control arm, a ball portion, and a module head. In some cases, the light module body may all be one continuous piece (e.g., including access to one or both ends), while in other cases, the light module body may comprise an assembly made from two or more separate parts. For example, the control arm and ball portion may be one continuous piece that attaches to the module head (e.g., by screwing into the module head), or some other suitable assembly as will be apparent in light of this disclosure. Note that the example light modules shown in FIGS. 1 and 2 are provided for illustrative purposes only and the claimed invention is not intended to be limited to the specific design shown. For example, the control arm is shown as a straight rod in the example embodiment of FIG. 2; however, in other embodiments, the control arm may be angled or curved. In one example embodiment, the control arm may have a tapering, conical shape, such that the diameter of the control arm decreases as it gets further away from the ball portion. Such an embodiment, may allow the control arm to be more closely and consistently constrained by the XY and focus plates over the full range of motion. In addition, the ball portion shown in FIG. 2 is below the control arm; however, in other embodiments, the ball portion may be in a different position in the light module body, such as above the control arm. Also note that the light modules shown in the array in FIG. 1 may be different from one another in design or configuration; however, they will primarily be treated as being the same herein for ease of description. Further, note that for purposes of illustration, the light module array is shown in a circular pattern; however, any suitable array pattern may be used as will be apparent in light of this disclosure.

The light modules may include any suitable light sources, such as one or more light-emitting diodes (LEDs), laser diodes, high intensity discharge (HID) bulbs, incandescent bulbs, and/or fluorescent bulbs, for example. In the example embodiment shown in FIG. 2, an LED light source having fixed optics (e.g., total internal reflection (TIR) lenses) is being used to provide the light beam when the light module is turned on. However, each light module may include any number of suitable light sources and optics suited for each light module may be selected as desired, as will be apparent in light of this disclosure. As previously described, the lighting fixtures as variously described herein can be used to control the spatial distribution of the light provided by the light modules included in the fixture, such as the aim (target) and/or focus (spread) of the light. In some embodiments, the light modules and/or the light sources used by the modules may facilitate additional features for the lighting fixture, such as brightness/dimming control or color changing/selection capabilities. For example, in one embodiment, the light modules may include color LEDs, or red-blue-green (R-G-B) LEDs or some other suitable multicolor LEDs, to allow a user to select or change the color of the light provided by the lighting fixture. As previously described, the multi-plate lighting fixtures as variously described herein include multiple light modules. In some cases, the light modules may be individually controlled to adjust spatial distribution, or other properties (e.g., color, brightness, etc.), of the light provided by the lighting fixture.

In some configurations, the light modules may be powered using a wired system, while in other configurations, the light sources may be powered wirelessly (e.g., using batteries). In some other configurations, the light modules may be powered by a combination of wired and wireless systems. For example, in such configurations, the wired power may serve as the primary source of power for the light modules and the wireless power may serve as a backup source (e.g., using backup batteries). Such cases may be particularly applicable useful in emergency or medical lighting applications. In addition, control of the light modules, including, for example, turning the modules on/off and controlling brightness levels, may be controlled using a wired system, wireless system, or some combination thereof. Suitable wiring, connectors, driver circuitry, and other such components for powering and controlling the light modules will be apparent in light of this disclosure. In some cases, electrical components may be selected based on the specific light sources being used by the light modules. Note that the electrical components used may be selected and/or configured to accommodate the motion of the light modules and the lighting fixture as a whole.

FIG. 3 illustrates a top view of an example base plate for use in the lighting fixture assembly of FIG. 1. As shown, the base plate has multiple light module sockets, each of which may be used to pivotally retain the ball portion of a light module (e.g., as shown in FIG. 1). Thus, the ball portion of the light module and the corresponding socket in the base plate can create a ball joint (or ball and socket joint) to allow free movement in two planes at the same time, including rotating in those planes. As a result, the ball joints that pivotally retain the light modules in the base plate sockets allow the module head of each light module to be pointed in a near semi-spherical range of motion. In some embodiments, the ball portions of the light modules and base plate sockets may be designed to allow the ball portion of each module to snap into corresponding base plate sockets to facilitate assembly of the lighting fixture. In other embodiments, the light module ball portions may be pivotally retained in the base plate sockets using some other suitable technique. For example, the base plate may be comprised of two separate parts that clamp together after the ball portion of each light module has been inserted between the two base plate parts. In embodiments where different light modules are being used in the same lighting fixture assembly, the ball portion of each light module and the corresponding base plate socket may be designed such that only they can be appropriately mated with each other. For example, the light modules used in a single lighting fixture may have different properties (e.g., different intensities, colors, etc.), and therefore the sizes of each ball/socket combination may be different to facilitate assembly of the lighting fixture.

As can be seen, the example base plate shown in FIG. 3 has a square shape and includes twelve light module sockets, which can be used to accommodate up to twelve light modules (e.g., as shown in FIG. 1). However, the base plate may be configured with any suitable shape, size, thickness, etc., and may include as many sockets for corresponding light modules as desired, as will be apparent in light of this disclosure. Note that in some cases, the number and/or design of the light modules used for the lighting fixture may drive the design of the base plate. For example, as previously discussed, the base plate may be comprised of two or more separate pieces that can be assembled to hold the light modules in a manner that allows them to pivot relative to the base plate. Also note that the base plate socket locations may be selected, in some cases, based on the desired array pattern for the light modules, and/or the design of the other plates used in the lighting fixture (e.g., the XY and focus plates).

FIGS. 4*a-b* illustrate a perspective and top view, respectively, of an example XY plate for use in the lighting fixture assembly of FIG. 1. FIGS. 5*a-b* illustrate a perspective and top view, respectively, of an example focus plate for use in the lighting fixture assembly of FIG. 1. As shown, the XY and focus plates each have multiple slots, which constrain the control arms of the light modules when the lighting fixture is assembled. In other words, the control arms are inserted into the slots in the XY and focus plates of the lighting fixture assembly, such that adjusting the XY and/or focus plates as described herein controls the direction that the light modules point. The XY plate in this example embodiment includes a series of radial slots that facilitate directing the light modules and the focus plate includes a series of angled slots that facilitate focusing the light modules. In some embodiments, the focus plate may have curved slots to facilitate smoother movement of the light modules (e.g., smoother in/out translation of the modules). Note that the slots may be formed in the plates in a recessed or angled manner (e.g., as can be seen in the perspective views of the XY and focus plates, FIGS. 4*a* and 5*a*, respectively) to allow the light modules to pivot as desired when the plates are moved to direct the light modules.

In the example embodiment shown in FIG. 1, the focus plate is shown stacked on and rotationally coupled to the XY plate, and the XY/focus plate stack is spaced away from the base plate. Since the focus plate is rotationally coupled to the XY plate, where the axis of rotation is the center of each plate in this example embodiment, they can rotate relative to each other. In some embodiments, the focus plate may be configured to rotate relative to the XY plate, but the assembly need not be so limited. As previously described, the base plate may be fixed or stationary and the XY/focus plate stack may be connected to the base plate using suitable connectors (e.g., arms, wires, etc.). In this example embodiment, the XY/focus plate stack can move relative to the fixed base plate to facilitate movement in at least one plane (e.g., in the X and Y direction of the XY plate's plane) relative to the base plate to point the light modules in the desired direction. Note that when the XY plate moves relative to the fixed base plate, the focus plate moves with the XY plate, since they are in a stack in this example embodiment. Also note that other embodiments may have different configurations. For example, in one example embodiment, the XY plate may be stationary or fixed and the base plate may move relative to the XY/focus plate stack. In another example embodiment, the base plate may be above the XY/focus plate stack. In such an example embodiment, the light modules may have ball portions that are located above the control arm.

Figure 6A:
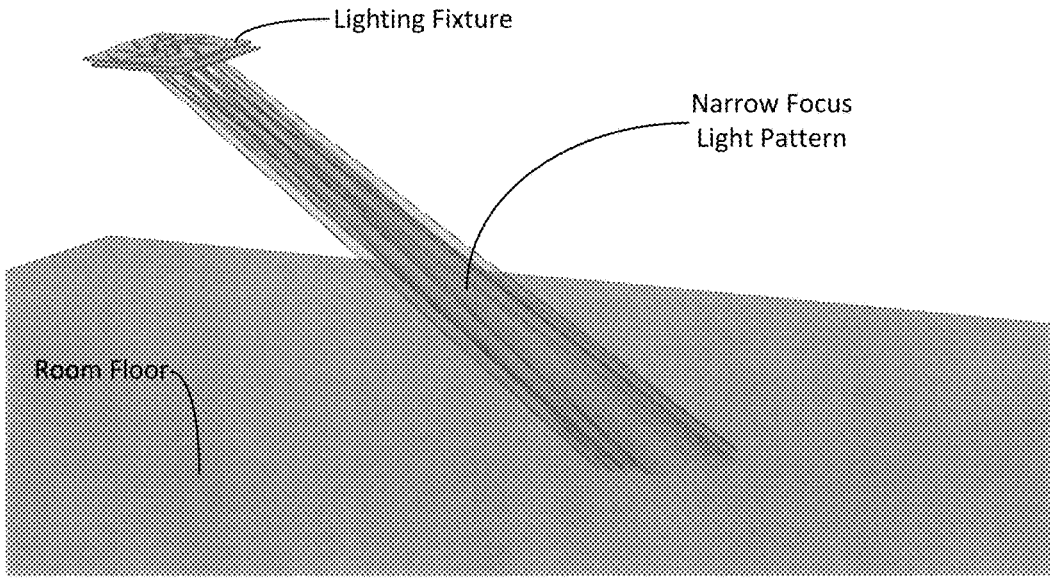
FIGS. 6*a-b* illustrate a lighting fixture having a narrow focus light pattern and a wide focus light pattern, respectively, in accordance with an embodiment of the present invention.
Figure 6B:
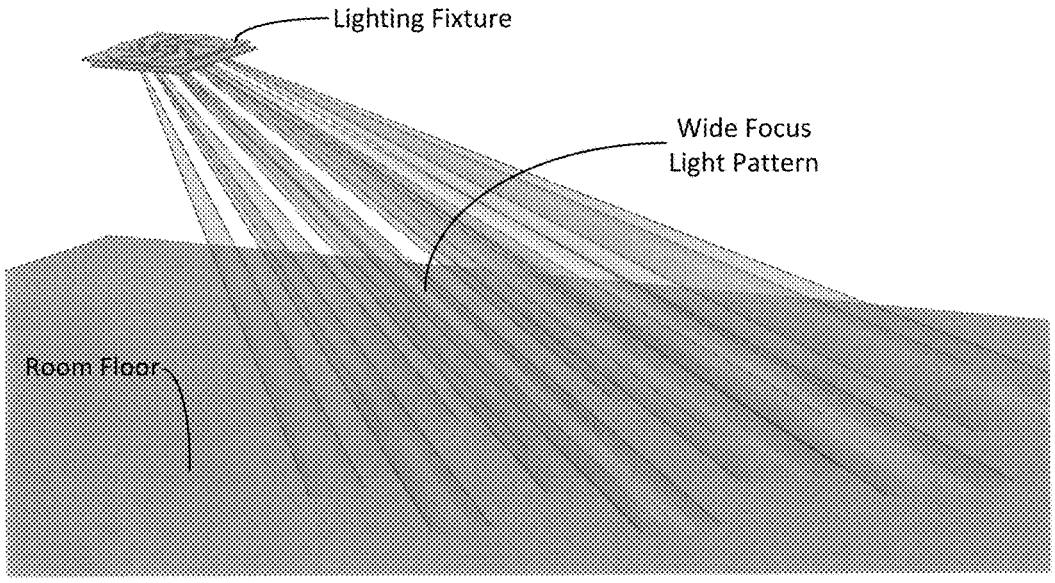

FIGS. 6*a-b* illustrate a lighting fixture having a narrow focus light pattern and a wide focus light pattern, respectively, in accordance with an embodiment of the present invention. The lighting fixture shown in FIGS. 6*a-b* is the same multi-plate fixture as described with reference to FIGS. 1-5*b* above. In this example embodiment, all of the fixture's light modules are turned on and providing a light beam which shines down to the room floor, as can be seen. Further, the focus plate (shown on the top of the lighting fixture) is rotationally coupled to the XY plate (shown between the focus plate and base plate) and the two plates are configured such that when they overlap, they constrain each light module control arm. Thus, the focus plate may be rotated relative to the XY plate (e.g., manually or in an automated fashion) to control the focus of the light pattern, as previously described. In FIG. 6*a*, the focus plate has been rotated counter-clockwise relative to the XY plate (from a viewpoint above the fixture) to narrow the focus of the light modules and cause the narrow focus light pattern shown. In FIG. 6*b*, the focus plate was rotated clockwise relative to the XY plate (from a viewpoint above the fixture) to widen the focus of the light modules and cause the wide focus light pattern shown.

As previously described, the light pattern may be aimed by moving the XY plate relative to the fixed base. For example, in the embodiment shown in FIGS. 1 and 6*a-b*, moving the XY plate relative to the base plate aims the light modules in the direction opposite that the XY plate is moved relative to the base plate. This is due to the XY plate, in this example embodiment, putting a force on the control arm end of the light modules, thereby causing the light module ball portion to pivot in the base plate sockets and aim the module head in the opposite direction. Note that the focus plate moves with the XY plate in this example embodiment, since the focus plate is rotationally coupled to the XY plate to make an XY/focus plate stack. Also note that in some embodiments, the XY plate may be stationary or fixed, allowing the base plate to move to control the aim of the light modules. Regardless of whether the base plate is fixed and the XY plate moves, or the XY plate is fixed and the base plate moves, movement of one of the plates is referred to herein as movement of the XY plate relative to the base plate.

Figure 7A:
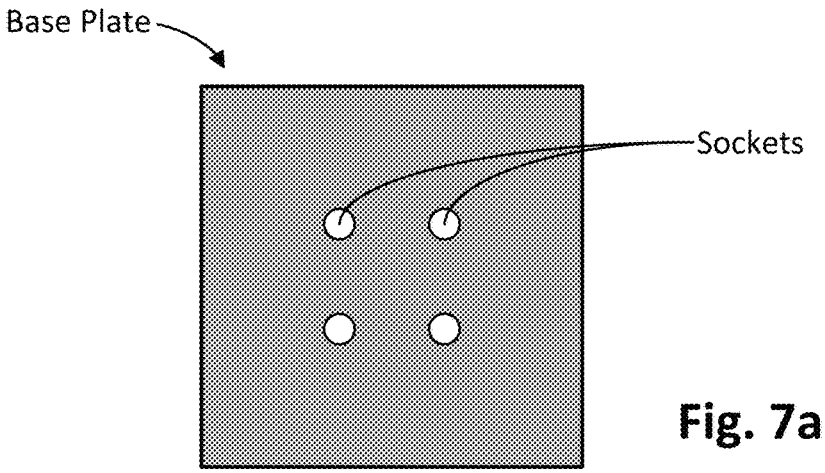
FIGS. 7*a-c* illustrate top views of an example base plate, XY plate, and focus plate, respectively, for use in a lighting fixture having spatial distribution control capabilities, in accordance with an embodiment of the present invention.
Figure 7B:
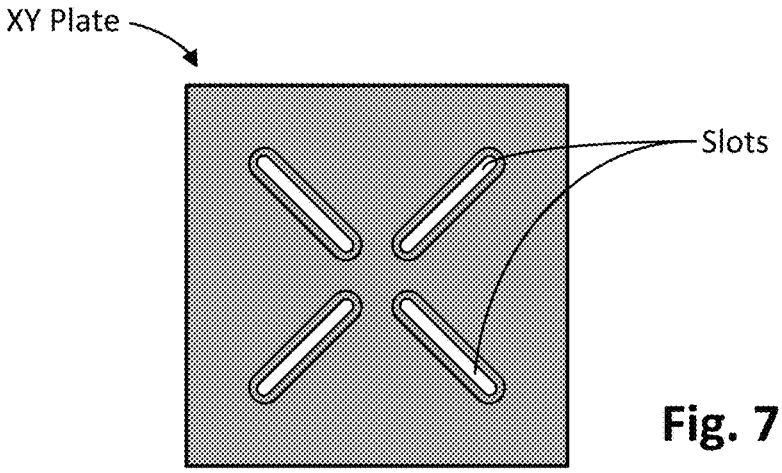
Figure 7C:
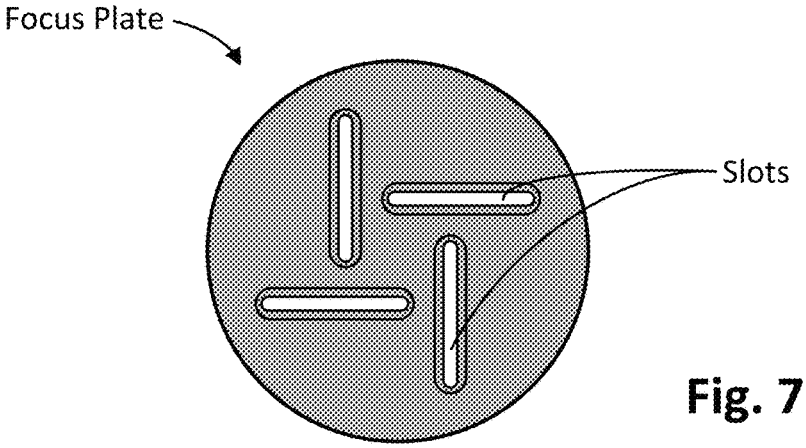

FIGS. 7*a-c* illustrate top views of an example base plate, XY plate, and focus plate, respectively, for use in a lighting fixture having spatial distribution control capabilities, in accordance with an embodiment of the present invention. The plates in this example embodiment are similar to the lighting fixture described above with reference to FIG. 1, except that these example plates are intended for use with a lighting fixture that includes four lighting modules. As shown in FIG. 7*a*, the base plate of this example embodiment includes four sockets, and as shown in FIGS. 7*b-c*, the XY and focus plates each include four slots. As previously described, the sockets are used to pivotally retain the ball portions of the light modules and the slots are used to constrain the control arms of the light modules, such that movement of the XY plate (relative to the base plate) controls the aim (target) of the light modules and rotation of the focus plate (relative to the XY plate) controls the focus (spread) of the light modules.

The light modules and plates described herein may be comprised of any suitable materials, including various plastics or other polymers (e.g., high density polyethylene (HDPE), polyethylene terephthalate (PET), polypropylene (PP), glass, fiberglass, etc.) and/or metals (e.g., aluminum, steel, stainless steel, copper, brass, etc.). In some cases, the body of the light module may include multiple materials. For example in the embodiment shown in FIG. 2, the control arm and ball portion may comprise a plastic material and the module head may comprise a metallic material. In some cases, the plates (e.g., base, XY, and focus) described herein may all be made from the same material, or from different materials. In some instances, the design and material for the light modules and plates may be selected to reduce production costs.

In some embodiments, the thicknesses of the plates and the design of the light modules may be chosen to have a short and/or flat overall design. For example, in some such embodiments, the maximum overall height of the lighting fixture (e.g., which may be achieved when the light modules are all perpendicular to the plates) may be less than 30, 20, or 10 cm, or some other suitable maximum overall height. In still other embodiments, the lighting fixture may be manufactured in the micro-machine realm and have an even lower profile, such as an example case where the maximum overall height of the fixture is, for example, 50 mm or less. To this end, computer numerical control (CNC) machining techniques can be used in the fabrication of the various plates and/or the various other structural features of the fixture so as to provide micro-sized features, or even smaller features, depending on factors such as the machining techniques and the materials used, as well as the aspect ratios and stresses the machined features are to withstand. Such lighting fixtures having a short overall design may have a form factor suitable for both general and specialty lighting, such as troffer-type fixtures or medical boom fixtures. One factor for the overall maximum height is the distance between the base plate and the XY/focus plate stack and therefore, in some embodiments, the distance may be selected based on the desired overall maximum height of the lighting fixture. Further, design and material selections for the lighting fixture components may be selected based on a desired weight for the fixture assembly. For example, light-weight materials, such as plastics and aluminum, may be selected for the plates and light modules to reduce the overall weight of the lighting fixture. The claimed invention is not intended to be limited to any particular materials for light modules or plates, unless otherwise indicated.

In some embodiments, the lighting fixture may be manually operated. In such embodiments, the fixture may be configured to allow a user to physically manipulate the fixture's plates to aim and/or focus the light module array to obtain a desired light pattern. For example, a user may be able to manually aim the array of the lighting fixture shown in FIG. 1 by physically moving the XY plate relative to the base plate and manually focus the array of the fixture by physically rotating the focus plate relative to the XY plate. In other embodiments, the lighting fixture assembly may be automated. In such embodiments, the lighting fixture may include one or more actuators to control movement of one or more of the plates (e.g., base, XY, and/or focus plates). For example, the one or more actuators or other components used for automated control may include motorized/electric actuators, piezoelectric actuators, hydraulic actuators, pneumatic actuators, linear motors or other motors, muscle wire, solenoids, relays, axles, or any other suitable components as will be apparent in light of this disclosure. Control techniques and user interfaces for such automated fixtures will be discussed in more detail below.

In accordance with some embodiments, the lighting fixture may be configured to be electrically coupled with driver circuitry (e.g., by wiring). In some cases, the driver circuitry may be external to the lighting fixture (e.g., in an electrical junction box). As will be appreciated in light of this disclosure, by virtue of such a configuration, the driver circuitry may be, in some cases, substantially thermally isolated from lighting device; that is, the driver circuitry may be isolated/protected, at least in part, from experiencing substantial increases/decreases in temperature, even if the lighting fixture or light modules therein experience such fluctuations. In some instances, this may help to increase the efficiency and/or lifetime of the lighting fixture. In some cases, the lighting fixture may optionally include or otherwise be capable of being electrically coupled with ballast circuitry, for example, to convert an AC signal into a DC signal at a desired current and voltage to power the light modules and optionally, power the componentry used to move the lighting fixture (e.g., for automated configurations). In other cases, the lighting fixture may include one or more batteries for powering the light modules and/or the componentry used to move the lighting fixture, such as the XY and focus plates. Numerous variations and configurations will be apparent in light of this disclosure.

Control Techniques and User Interfaces

Figure 8A:
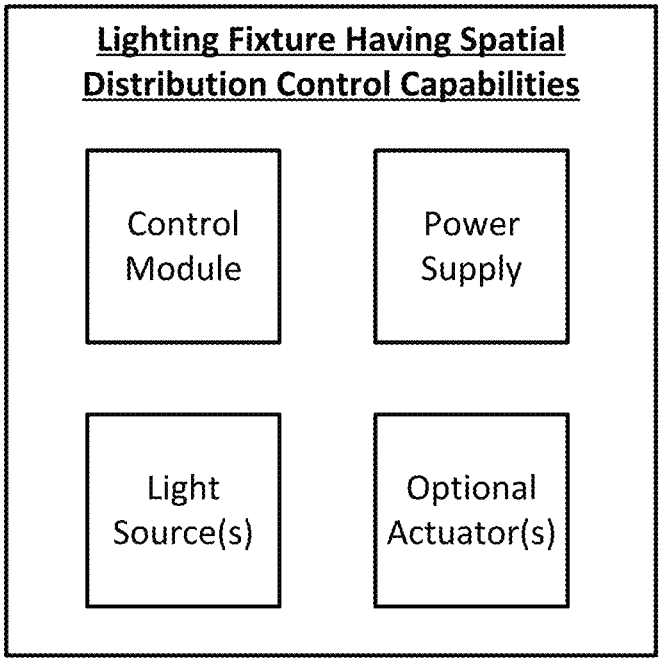
FIGS. 8*a-b* illustrate example architectures for a lighting fixture having spatial distribution control capabilities and a high-level controller for the fixture, respectively, in accordance with one or more embodiments of the present invention.
Figure 8B:
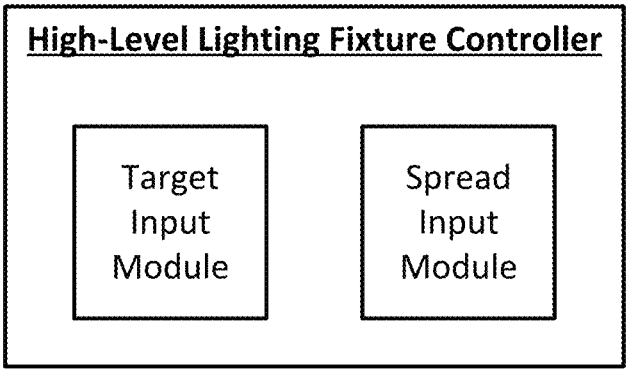

FIGS. 8*a-b* illustrate example architectures for a lighting fixture having spatial distribution control capabilities and a high-level controller for the fixture, respectively, in accordance with one or more embodiments of the present invention. As will be apparent in light of this disclosure, the control techniques described herein use a high-level controller (e.g., as shown in FIG. 8*b*) to define a desired distribution using target and spread inputs to control the spatial distribution of a lighting fixture (e.g., as shown in FIG. 8*a*). The inputs for the desired light pattern distribution, such as target coordinates (X,Y,Z) and spread radius (R), may be provided to a control module that determines the appropriate movement(s)/light source adjustment(s) for the specific lighting fixture(s) being controlled. The lighting fixture shown in FIG. 8*a* will primarily be discussed in the context of a multi-plate lighting fixture as described above (e.g., with reference to FIG. 1) for ease of description. However, as will be apparent in light of this disclosure, the control techniques as variously described herein may be used with any lighting fixture having spatial distribution control capabilities, such as a moving head lighting fixture or a stationary fixture having multiple light sources (e.g., where aiming and/or focusing is controlled by turning the light sources of the stationary fixture on and off, or by adjusting the optics of the light sources). Note that the control techniques described herein may be used to control multiple lighting fixtures having spatial distribution control capabilities, as will be discussed below. Also note that although the lighting fixtures and control techniques are primarily discussed herein as being capable of controlling both illumination aim (target) and focus (spread), the lighting fixtures and/or control techniques may only be capable of controlling one or the other.

Continuing with the example embodiment shown in FIG. 8*a*, as can be seen, the lighting fixture includes a control module, one or more light sources, a power supply, and one or more actuators. Note, as previously described, in the case of lighting fixtures that are stationary, actuators may not be included with the fixture, since the fixture may not have any active mechanical components. The lighting fixture light source(s) may be distributed among multiple light modules, which may be configured in an array (e.g., as shown in FIG. 1), and may include any suitable type of light source (e.g., as described with reference to FIG. 2). The power supply for the lighting fixture and its components may include wired power sources (e.g., AC power sources), wireless power sources (e.g., batteries), or some combination thereof. The one or more actuators used for moving the lighting fixture to control, for example, the spatial distribution of the fixture's light source(s) may include any suitable actuator type, such as those previously described above.

In the embodiment shown in FIG. 8*a*, the control module is included with the lighting fixture. However, in other embodiments, the control module may be located in any other suitable location or device, such as in an external controller or a computing system used to facilitate control of one or more lighting fixtures, for example. As previously described, the control module is configured to receive inputs from a high-level controller. As shown in FIG. 8*b*, the high-level controller may include at least a target input module and a spread input module for receiving target coordinates and a spread radius, respectively. The high-level controller of FIG. 8*b* may also allow a user to provide other input to the lighting fixture (e.g., via the control module), such as on/off input, light color input, or other suitable input, commands, or controls, as will be apparent in light of this disclosure.

In some cases, the high-level controller (e.g., as shown in FIG. 8*b*) may be a separate component, such as a dedicated remote control, that may be provided with the lighting fixture or control module, for example. In other cases, the high-level controller may also come in the form of an application for a computer, tablet, smart phone, or other suitable computing device capable of installing the application. In such cases, the high-level controller application may come as a downloadable application for one or all of the Google/Android, Microsoft/Windows, or Apple/iOS operating systems, for example, or any other suitable operating system. In either case, the device running the high-level controller application may include a display screen and various input control features, such as a touch screen, touch pad, joystick, keypad, control buttons, or other suitable control features. Further, the high-level controller may be wired to one or more lighting fixtures, or it may operate wirelessly using infrared (IR), radio frequency (RF), Bluetooth, Wi-Fi, etc. As previously described, the high-level controller allows control of spatial light distribution in an intuitive manner, where the user can input the desired result of the light distribution pattern (e.g., by inputting a target and spread for one or more lighting fixtures), which is communicated/transmitted to the control module such that the control module can determine the appropriate movement(s)/light source adjustment(s) for the specific lighting fixture(s) being controlled.

In some cases, the high-level controller may have gesture or voice recognition capabilities. For example, such capabilities may be useful in the context of medical lighting, particularly in a clean environment where the spatial light distribution pattern of a lighting fixture can be controlled without touching the controller or fixture itself. In some cases, the high-level controller may be configured with implicit or autonomous control schemes, which may come pre-programmed or be user-configurable. For example, such implicit or autonomous control schemes may include adjusting the spatial distribution of the light pattern based on occupancy or users in the room, based on a specific activity, or based on intent recognition. The implicit/autonomous control schemes may be pre-programmed using the desired inputs (e.g., target and spread). For example, a user may program preset illumination targets and spreads based on the room layout, such as illuminating the kitchen prep area, illuminating the dining room table, and providing ambient illumination, based on the activity being performed (e.g., preparing a meal, eating a meal, watching a movie, respectively). Setting such presets is an intuitive process when dealing with the target and spread of the one or more lighting fixtures being controlled. Any suitable componentry and supporting software for achieving the various control schemes previously described may be used (e.g., cameras, motion sensors, microphones, etc.). Numerous high-level controller variations and configurations will be apparent in light of this disclosure.

Figure 9A:
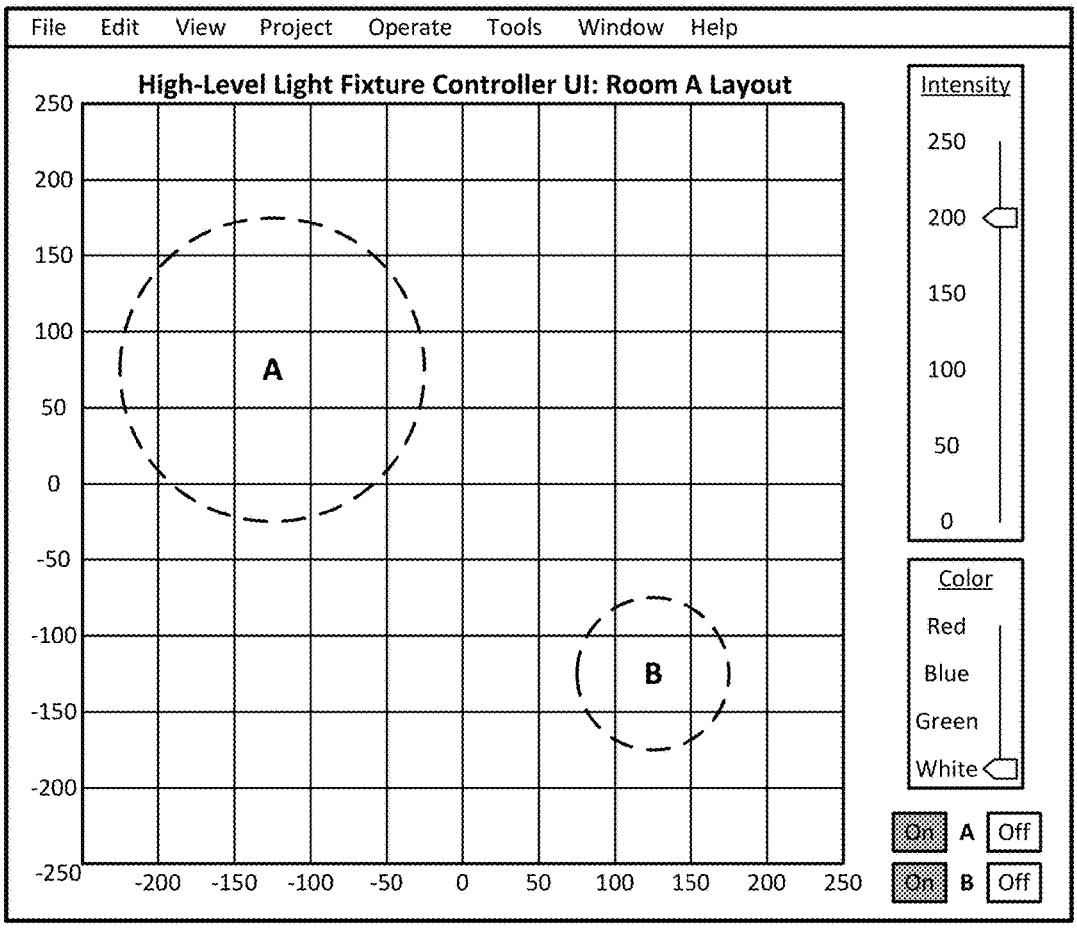
FIGS. 9*a-b* illustrate example screen shots of a user interface (UI) for controlling a light system having spatial distribution control capabilities, in accordance with an embodiment of the present invention.
Figure 9B:
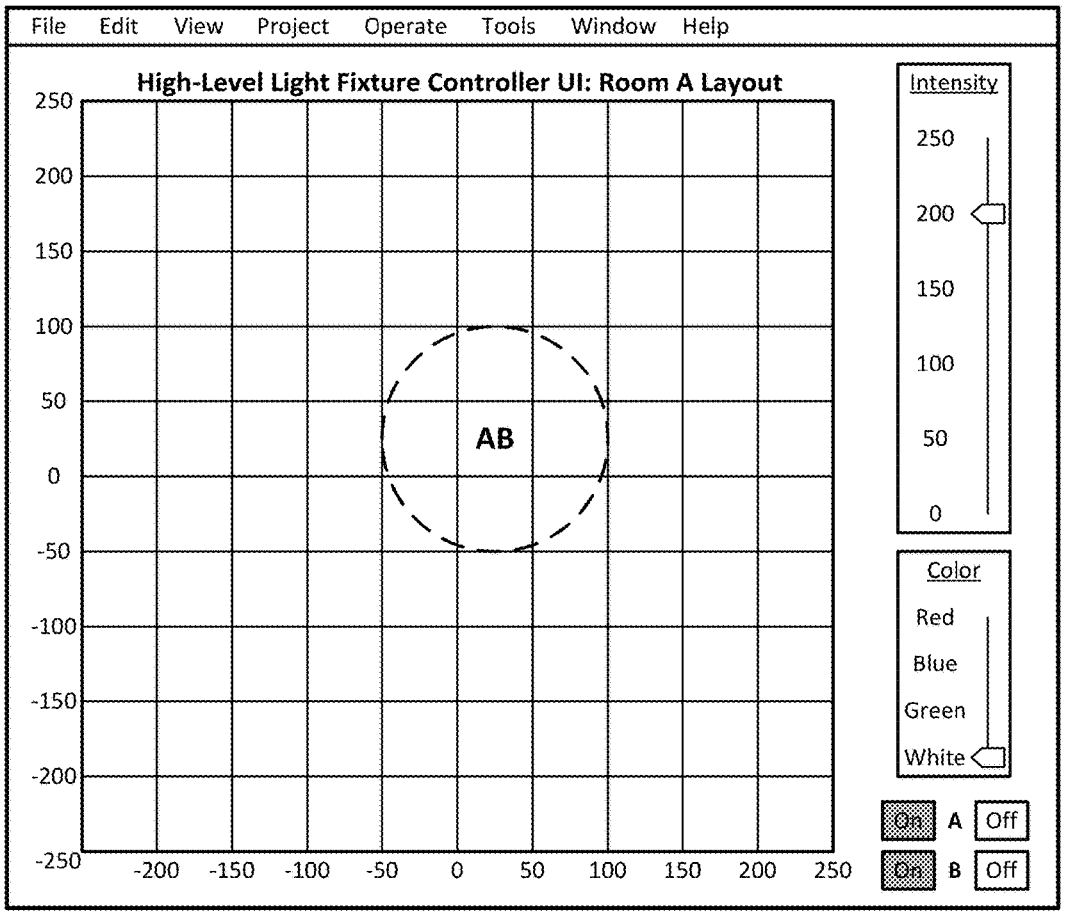

FIGS. 9*a-b* illustrate example screen shots of a user interface (UI) for controlling a light system having spatial distribution control capabilities, in accordance with an embodiment of the present invention. The user interface as shown may be displayed by the high-level controller (e.g., on a touch screen computing device, such as a smart phone or tablet) to allow input of target and spread for one or more lighting fixtures. In this example case, the main portion of the user interface shows a virtual map layout for Room A including two lighting fixtures that can be controlled, Fixture A and Fixture B (represented by corresponding dotted circles as shown). Note that Room A is a perfect square of 500×500 for illustrative purposes and that both Fixture A and B may have been initially calibrated to Room A as will be described below. Also note that although two lighting fixtures having spatial distribution control capabilities are used in this example light system, any number of lighting fixtures may be used in such a system, including one or more. Further note that the high-level controller may be capable of controlling stationary or non-movable fixtures and light sources. Such stationary/non-movable sources can be considered when determining ways to achieve a desired light pattern.

In the example UI shown in FIG. 9*a*, the target of each lighting fixture may be controlled by dragging the corresponding center of the circle for Fixture A or Fixture B to the desired location in Room A. Further, the spread of each fixture may be controlled in this example UI by dragging the circle toward or away from its center to narrow or widen the light focus, respectively. As shown, Fixture A is targeted at (−125, 75) and has a spread radius of 100, and Fixture B is targeted at (125, −125) and has a spread radius of 50. Although only the X and Y coordinates of Room A are being used in this example embodiment for illustrative purposes, in some cases, the Z coordinate of a room/area of use may be input to adjust the height of the light pattern, for example. For example, the Z coordinate may be used to cause an illumination pattern that targets the walls of a room. Further, in some cases, only one coordinate may be controllable for a lighting fixture. For example, if the lighting fixture is illuminating a hallway, the user may only control one target axis to adjust illumination up and down the hallway.

Any suitable control techniques may be used depending upon the particular UI and number of lighting fixtures being controlled. For example, if only one lighting fixture was being controlled using the UI shown in FIG. 9*a* (e.g., Fixture A), the user may be able to select the target location to move the representative circle and control the fixture (as opposed to dragging the representative circle). FIG. 9*b* shows an example feature where both Fixture A and Fixture B are being used to cause a single illumination pattern. FIG. 9*b* will be discussed in more detail below. Note that the UI in this example embodiment also allows the user to control the intensity and color of the lighting fixtures, and individually turn them on or off. Also note that the UI shown in FIGS.

9*a-b* is provided as an example for illustrative purposes only, and are not intended to limit the claimed invention.

Figure 10:
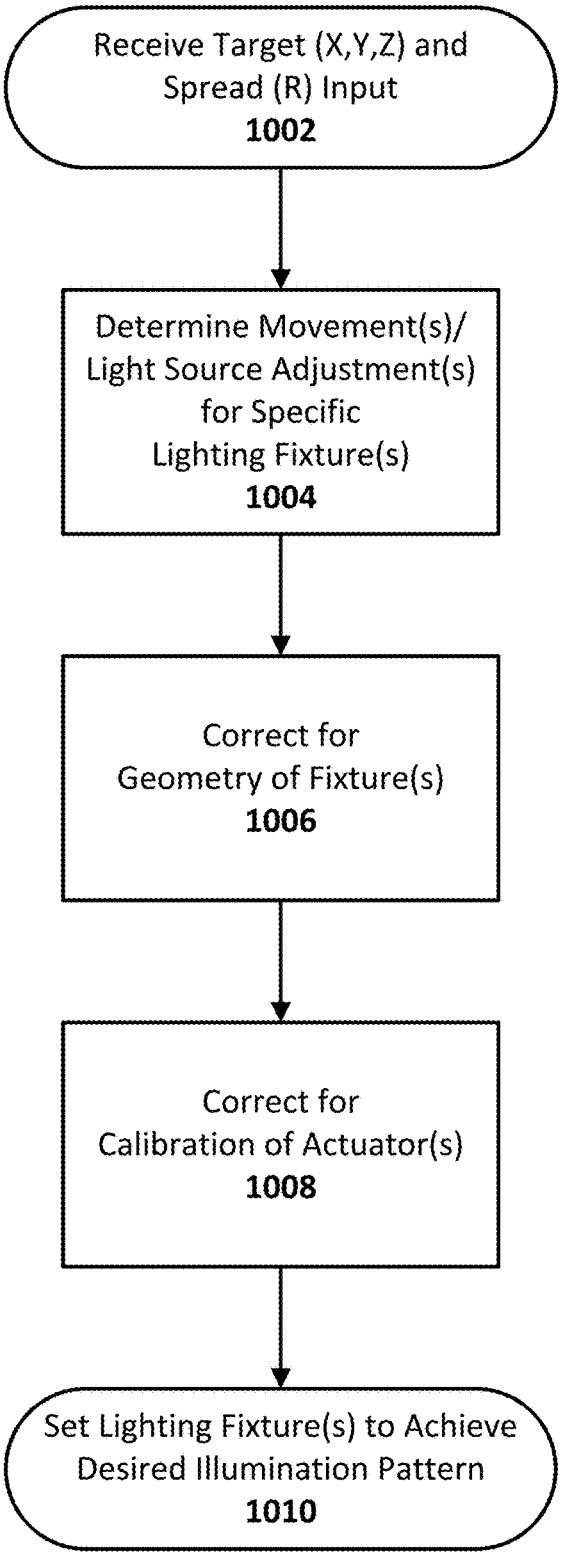
FIG. 10 is a flow diagram illustrating a method for controlling spatial light distribution of one or more lighting fixtures, in accordance with one or more embodiments of the present disclosure.

Continuing with description relating to the control module, FIG. 10 is a flow diagram illustrating a method for controlling spatial light distribution of one or more lighting fixtures, in accordance with an embodiment of the present disclosure. The methodology shown in FIG. 10 provides an example of a process that may be carried out by the control module to achieve the desired spatial light distribution pattern. The control module can be implemented, for example, using any suitable programming language, such as C, C++, objective C, JavaScript, G (from LabVIEW), custom or proprietary instruction sets, etc. The control module functionality can be encoded, for example, on a machine or computer-readable medium that, when executed by the processor, carries out the functionality described herein with reference to the control module, in part or in whole. The machine or computer-readable medium may be any suitable non-transitory computing device memory that includes executable instructions, such as: a hard drive; a compact disk; a memory stick; and/or any combination thereof. Other embodiments may be implemented, for instance, with gate-level logic, an application-specific integrated circuit (ASIC) or chip set, or other such purpose-built logic. Some embodiments can be implemented with a microcontroller having input/output capability (e.g., inputs for receiving user inputs; outputs for directing other components) and a number of embedded routines for carrying out the functionality of the control module. In a more general sense, the control module can be implemented in hardware, software, and/or firmware, as desired.

As discussed above, the high-level controller may be configured to transmit a desired target input and spread input for one or more lighting fixtures to the control module. The control module receives 1002 the target and spread inputs, which may be in units of X, Y, and/or Z coordinates (e.g., in a vector format) for the desired target and a radius (R) for the desired spread. Note that the dimensions of the room (e.g., in feet or meters) may be used to set the coordinates or units for the high level controller. For example, for a square room or area measuring 20 m×20 m and including a lighting fixture having spatial distribution control capabilities, the origin may be set in one corner, which may allow a user to input a target ranging from (0 m, 0 m) to (20 m, 20 m), and set a radius in the range of 0 to 10 m. Also note that although the spread is discussed herein in the context of a radius unit, the shape of the light pattern need not be circular and use of the radius term for spread is meant to generally apply to the area covered by the light pattern. Therefore, a higher radius indicates a light pattern with a wider spread that illuminates a greater area and a lower radius indicates a light pattern with a narrower spread that illuminates a lesser area, regardless of the shape of the light pattern.

The method continues with determining 1004 the movement(s) and/or light source adjustment(s) for the specific lighting fixture(s) the control module is controlling. Since the units input into the high-level controller are for a given area to be lit, the control module may be responsible for translating the received inputs (e.g., target and spread) to obtain the desired illumination pattern using the appropriate calculations/corrections specific to each lighting fixture it controls. In some embodiments, a calibration process may be performed to identify the location of each lighting fixture in a given area to be lit. For example, the user may have to set the location of the fixture(s) coordinates (e.g., using X, Y, and/or Z coordinates), such that the control module has an understanding of where in the room each fixture is located. This may be performed by entering the location of each lighting fixture or through a more sophisticated calibration process (e.g., using sensors). In some cases, information about the size and/or shape of the room/area of use may need to be provided to set the proper dimensions for that space. The starting location for each fixture can be used to determine/calculate suitable movement(s) and/or light source adjustment(s) for the specific lighting fixture(s) being controlled, as will be apparent in light of this disclosure.

In some cases, the control module may have to correct 1006 for the geometry of one or more of the fixtures it controls and/or correct 1008 for the calibration of any actuators used by the fixture(s). For example, in the case of lighting fixtures that control spatial distribution using active mechanical components (e.g., the multi-plate lighting fixtures described above, moving head lighting fixtures, etc.), the control module may be programmed to correct for the specific hardware of the lighting fixtures, including correcting for the geometry of each fixture and the calibration of actuators or other mechanical components used for each fixture, to translate the received inputs into movements that cause the desired aim (target) and focus (spread) of the light pattern. In the case of lighting fixtures that control spatial distribution by turning the light sources on and off and/or by adjusting the light sources' optics, the control module may be programmed to correct for the specific geometry of the lighting fixture to ensure that the desired light sources are turned on and/or the appropriate optics are used to obtain the desired illumination.

FIG. 11 illustrates an example control module pseudo code for corrections and calculations of a lighting fixture having spatial distribution control capabilities, in accordance with an embodiment of the present invention. The example corrections/calculations in the pseudo code shown are for a multi-plate lighting fixture as described above (e.g., with reference to FIG. 1). Note that for the provided corrections/calculations, the lighting fixture includes linear servo motors that can be used to provide plate movement to control the fixture. The first section in the box of FIG. 11 relates to linear corrections for the XY plate movement. As can be seen, constants are defined (which are derived from the physical make up and calibration of the particular lighting fixture being used) and a target vector (X,Y,Z) is received as an input. Calculations can then be performed using the fixture-related constants and target vector input to set the lighting fixture to achieve the desired illumination pattern based on the received target vector. As shown, the calculations include translating the target vector input to the desired plate position and correcting for the calibration of the actuators.

The second section in the box of FIG. 11 relates to rotational corrections for the focus plate movement. As can be seen, constants are once again defined (which are derived from the physical make up and calibration of the particular lighting fixture being used). Inputs are also received, which include a focus input that indicates the desired radius of the illumination pattern spread and a distance input that indicates the distance from the fixture to the center of the desired illumination pattern. Calculations can then be performed using the fixture-related constants and the inputs to set the lighting fixture to achieve the desired illumination pattern based on the received target vector. As shown, the calculations include determining the narrowest or tightest focus (spread) possible, and calibrating the desired rotation of the focus plate based on the target of the illumination pattern. In this manner, the control module can determine the movement of the XY and focus plates for a given target and focus input, including correcting for the geometry of the fixture and the calibration of the actuators. Note that the pseudo code provided in FIG. 11 including corrections/calculations for a multi-plate lighting fixture is provided for illustrative purposes only and is not intended to limit the claimed invention.

The method in this example embodiment continues by setting 1010 the lighting fixture(s) to achieve the desired illumination pattern. The lighting fixture may be set after suitable movement(s) and/or light source adjustment(s) have been determined 1004 or after suitable corrections 1006, 1008 have been performed, for example. Setting the lighting fixture may include controlling the actuators (or other mechanical componentry) used to move the lighting fixture. For example, using the multi-plate lighting fixture described herein with reference to FIG. 1, setting the fixture may include moving the XY plate relative to the base to aim the array of light modules and achieve the desired illumination target and/or rotating the focus plate relative to the XY plate to focus the array of light modules and achieve the desired illumination spread. In another example case, using a moving head lighting fixture, setting the fixture may include panning and/or tilting the fixture to achieve the desired illumination target and/or altering the optics of the fixture to achieve the desired illumination spread. In yet another example case, using a stationary lighting fixture, setting the fixture may include turning the light sources on or off (or possibly altering the optics of the light sources) to achieve the desired illumination target and/or spread.

In some embodiments, the control module may be configured to control the respective aim (target) and/or focus (spread) of multiple lighting fixtures, causing each one to provide individual illumination patterns. For example, the case described above with reference to FIG. 9*a* allows for the individual control of Fixture A and Fixture B. In such a scenario, each fixture may have its own control module to translate the provided target and spread into the desired illumination patterns shown. Alternatively, one control module may be used to control both fixtures and translate the inputs provided by the example UI to determine the appropriate movement(s)/light source adjustment(s) needed to cause the desired illumination pattern of each fixture. In some other embodiments, multiple lighting fixtures may be used to provide one illumination pattern, such as is shown in FIG. 9*b*. In such an example case, the control module may control both lighting fixtures and may be programmed with the requisite intelligence to determine how to achieve the desired illumination pattern using both of the fixtures. This case may be applied to a lighting system including two or more lighting fixtures having spatial distribution control capabilities. For completeness of description, the illumination pattern created by the combination of Fixture A and Fixture B in FIG. 9*b* has a target of (25, 25) and a spread radius of 75.

Numerous variations on this method will be apparent in light of this disclosure. As will be appreciated, and in accordance with an embodiment, each of the functional boxes (e.g., 1002, 1004, 1006, 1008, and 1010) shown in FIG. 10 can be implemented, for example, by the control module and/or some other sub-module that, when executed by one or more processors or otherwise operated, causes the associated functionality as described herein to be carried out. The control module/sub-modules may be implemented, for instance, in software (e.g., executable instructions stored on one or more computer-readable media), firmware (e.g., embedded routines of a microcontroller or other device which may have input/output capacity for soliciting input from a user and providing responses to user requests), and/or hardware (e.g., gate-level logic, field-programmable gate array, purpose-built silicon, etc.).

Numerous embodiments will be apparent in light of this disclosure. One example embodiment of the present invention provides a method of controlling a lighting fixture. The method includes receiving a target input and a spread input for a lighting fixture in a given area to be lit, determining the movements and/or light source adjustments for the lighting fixture based on the received target and spread inputs, and setting the lighting fixture to achieve the desired illumination target and spread based on the determined movements and/or light source adjustments. In some cases, the target input is defined by X, Y, and/or Z coordinates of the area. In some cases, the spread input is defined by the radius of light provided by the lighting fixture light. In some cases, the method includes correcting for the geometry of the lighting fixture and/or correcting for the calibration of one or more lighting fixture actuators. In some cases, the method includes calibrating the lighting fixture to define its location in the area. In some cases, the target input and spread input are received from a high-level controller. In some cases, setting the lighting fixture includes adjusting one or more actuators to achieve the desired illumination target and spread. In some cases, setting the lighting fixture includes turning light sources on or off to achieve the desired illumination target and spread. In some cases, a control module is configured to perform the method of controlling a lighting fixture. In some such cases, the control module is included in the lighting fixture. In some cases, a (non-transitory) computer-readable medium is encoded with instructions that, when executed by one or more processors, cause a process for controlling the spatial distribution of a lighting fixture to be carried out, the process including the method of controlling a lighting fixture.

Another example embodiment of the present invention provides a lighting system including at least one lighting fixture, a high-level controller including a user interface configured to receive a target input and spread input for the at least one lighting fixture, and at least one control module configured to determine the movements and/or light source adjustments for the at least one lighting fixture to achieve at least one desired illumination pattern based on the received target and spread inputs. In some cases, a single control module is configured to control a plurality of lighting fixtures to achieve one or more illumination patterns. In some cases, the at least one control module is calibrated with the location of each lighting fixture it controls. In some cases, the control module corrects for the geometry of the lighting fixture and/or corrects for the calibration of one or more lighting fixture actuators.

Yet another example embodiment of the present invention provides a high-level controller for controlling a lighting system. The controller includes a display for displaying a virtual area to a user; and a user interface configured to receive target and spread inputs for at least one lighting fixture to cause at least one illumination pattern, wherein the received target and spread inputs are transmitted to at least one control module for controlling the at least one lighting fixture. In some cases, the at least one illumination pattern for the at least one lighting fixture is displayed as a circle that can be manipulated to adjust the target and spread inputs. In some cases, the display is a touch screen display for displaying the virtual area and allowing user input. In some cases, controlling the at least one lighting fixture includes determining the movements and/or light source adjustments for the at least one lighting fixture based on the received target and spread inputs. In some cases, the user interface is further configured to receive intensity and/or color inputs for the at least one lighting fixture which are transmitted to the at least one control module for controlling the at least one lighting fixture.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method of controlling a plurality of lighting fixtures, the method comprising:

receiving a target input and a spread input for the plurality of lighting fixtures in a given area to be lit;

determining the movements and/or light source adjustments for the plurality of lighting fixtures based on the received target and spread inputs; and setting the plurality of lighting fixtures to achieve the desired illumination target by moving a XY plate relative to a base plate and spread by moving a focus plate relative to the base plate based on the determined movements and/or light source adjustments.

2. The method of claim 1 wherein the target input is defined by X, Y, and/or Z coordinates of the area.

3. The method of claim 1 wherein the spread input is defined by the radius of light provided by the plurality of lighting fixtures.

4. The method of claim 1, further comprising correcting for the geometry of the plurality of lighting fixtures and/or correcting for the calibration of one or more lighting fixture actuators.

5. The method of claim 1, further comprising calibrating the plurality of lighting fixtures to define its location in the area.

6. The method of claim 1 wherein the target input and spread input are received from a high-level controller.

7. The method of claim 1 wherein setting the plurality of lighting fixtures includes adjusting one or more actuators to achieve the desired illumination target and spread.

8. The method of claim 1 wherein setting the plurality of lighting fixtures includes turning light sources on or off to achieve the desired illumination target and spread.

9. A control module configured to perform the method of claim 1.

10. The control module of claim 9 wherein the control module is included in the plurality of lighting fixtures.

11. A computer-readable medium encoded with instructions that, when executed by one or more processors, cause a process for controlling the spatial distribution of a lighting fixture to be carried out, the process comprising the method of claim 1.

12. A lighting system, comprising:

at least one lighting fixture including a XY plate, a focus plate and a base plate located substantially parallel to each other and further including a light module in contact with each of the XY plate, the focus plate, and the base plate;

a high-level controller including a user interface configured to receive a target input and spread input for the at least one lighting fixture; and at least one control module configured to determine the movements and/or light source adjustments for the at least one lighting fixture to achieve at least one desired illumination pattern based on the received target by only moving the XY plate relative to the base plate and spread inputs by only moving the focus plate relative to the base plate.

13. The system of claim 12 wherein a single control module is configured to control a plurality of lighting fixtures to achieve one or more illumination patterns.

14. The system of claim 12 wherein the at least one control module is calibrated with the location of each lighting fixture it controls.

15. The system of claim 12 wherein the control module corrects for the geometry of the lighting fixture and/or corrects for the calibration of one or more lighting fixture actuators.

16. A controller for controlling a lighting system, the controller comprising:

a display for displaying a virtual area to a user; and a user interface configured to receive target and spread inputs for at least one lighting fixture to cause at least one illumination pattern, wherein the received target and spread inputs are transmitted to at least one control module for controlling the at least one lighting fixture; and at least one control module configured to determine the movements and/or light source adjustments for at least one lighting fixture to achieve at least one desired illumination pattern based on the received target by causing rotation of a XY plate relative to a base plate and spread inputs by causing rotation of a focus plate relative to the base plate.

17. The controller of claim 16 wherein the at least one illumination pattern for the at least one lighting fixture is displayed as a circle that can be manipulated to adjust the target and spread inputs.

18. The controller of claim 16 wherein the display is a touch screen display for displaying the virtual area and allowing user input.

19. The controller of claim 16 wherein the user interface is further configured to receive intensity and/or color inputs for the at least one lighting fixture which are transmitted to the at least one control module for controlling the at least one lighting fixture.

* * * * *